US007540758B2

(12) United States Patent
Ho

(10) Patent No.: US 7,540,758 B2
(45) Date of Patent: Jun. 2, 2009

(54) GROUNDING BLOCKS AND METHODS FOR USING THEM

(76) Inventor: Kesse Ho, 13461 Pepperdine Cir., Westminster, CA (US) 92683

( * ) Notice: Subject to any disclaimer, the term of this patent is extended or adjusted under 35 U.S.C. 154(b) by 0 days.

(21) Appl. No.: 11/929,246

(22) Filed: Oct. 30, 2007

(65) Prior Publication Data

US 2008/0153328 A1 Jun. 26, 2008

Related U.S. Application Data

(60) Provisional application No. 60/876,337, filed on Dec. 21, 2006.

(51) Int. Cl.
*H01R 4/24* (2006.01)

(52) U.S. Cl. ..... 439/394; 438/98; 438/409; 174/78

(58) Field of Classification Search ..... 439/98, 439/100, 394, 409, 410, 439; 174/40 CC, 174/78

See application file for complete search history.

(56) References Cited

U.S. PATENT DOCUMENTS 3,836,943 A * 9/1974 Horak ..... 439/394
4,201,433 A * 5/1980 Caldwell ..... 439/98
5,122,068 A * 6/1992 Koss ..... 439/98
5,829,992 A * 11/1998 Merker et al. ..... 439/98
6,297,447 B1 * 10/2001 Burnett et al. ..... 174/40 CC
6,591,055 B1 * 7/2003 Eslambolchi et al. ..... 385/136
7,018,221 B2 * 3/2006 Daume ..... 439/100
7,306,476 B2 * 12/2007 Gerlich et al. ..... 439/394
2008/0020612 A1 * 1/2008 Clark et al. ..... 439/100

* cited by examiner

*Primary Examiner*—Hien Vu
(74) *Attorney, Agent, or Firm*—William A. English; Vista IP Law Group LLP

(57) ABSTRACT

Grounding block are provided for grounding a coaxial cable. The grounding block includes first and second block portions connected together such that the portions are movable between open and closed positions to receive a coaxial cable within a recess between the block portions. The block portions include cutting elements having a shape for penetrating an outer jacket of the cable to contact a shield layer thereof without cutting into a dielectric layer of the cable. A grounding wire is coupled to the grounding block for grounding the shield layer.

23 Claims, 15 Drawing Sheets

GROUNDING BLOCKS AND METHODS FOR USING THEM

This application claims benefit of co-pending provisional application Ser. No. 60/876,337, filed Dec. 21, 2006, the entire disclosure of which is expressly incorporated by reference herein.

FIELD OF THE INVENTION

The present invention relates generally to apparatus and methods for grounding electrical cables, such as coaxial cables, and, more particularly, to grounding blocks for coaxial cables, and to methods for using such grounding blocks.

BACKGROUND

The National Electric Code ("NEC") dictates that, for safety reasons, before a coaxial cable enters a residence, there must be a cable shield grounding point at the point of entry. The coaxial shield should make contact with an earth-grounded wire of a size no smaller than #8 for Aluminum or no smaller than #10 for solid copper. Grounding serves the additional purpose of reducing equipment damage from lightening.

The present-day grounding approach is to use a device called a "grounding block." FIGS. 1A-1C show top views of exemplary grounding blocks, showing single 10, dual 10', and quad 10" versions, respectively, including F-connector terminals. The grounding blocks may also serve as a connection point for one or more grounding wire(s) for other devices/components, such as a dish antenna or an off-the-air antenna.

With reference to FIG. 1A, an F-connector grounding block 10 may be used to ground a coaxial cable, e.g., from an antenna mounted to a residence (not shown). A first male F-connector may be mated or otherwise provided on an end of a first length of coaxial cable (e.g., that extends from the antenna), and the first connector may be threaded into an F-connector input 12 on the grounding block 10. A second male F-connector is mated with a second coaxial cable (e.g., that extends into the residence), and the second connector may be threaded into an F-connector output 14 of the grounding block 10 opposite the F-connector input 12 (e.g., if the grounding block includes multiple connections). For example, a coaxial cable may be cut, and connectors mated to the cut ends before connecting the ends to the F-connectors 12, 14 of the grounding block 10.

The grounding block 10 may include one or more holes to receive grounding wires (not shown), e.g., #8 Aluminum or #10 solid copper grounding wires, and one or more screws 16 that may be tightened to secure the grounding wires in respective holes. The grounding wire(s) may be extended to nearby earth ground point(s), e.g., per codes by the NEC.

Other known methods for grounding coaxial cables involves stripping or otherwise removing the cable jacket to expose the underlying shield and cutting into the cable's braided shield and dielectric layers. Stripping or removing the jacket may be time-consuming and cutting into the braided shield and dielectric layers may alter the characteristic impedance of the coaxial cable. Such impedance changes may be acceptable for low frequency signals, e.g., in the Kilohertz (KHz) range, such as those encountered in audio applications, but are generally unacceptable for high frequency signals, e.g., radiofrequency ("RF") signals in the Megahertz (MHz) and Gigahertz (GHz) ranges.

Two of the primary problems associated with grounding blocks, such as those shown in FIGS. 1A-1C are the extra time required to make the F-connector/cable assemblies, and the cost of the F-connectors required for each end of a spliced cable. For example, with a four-cable distribution system using a quad grounding block, such as that shown in FIG. 1C, a total of eight (8) F-connector/cable assemblies must be fabricated on site. This may be further inconvenient given that the connectors and connections may be made at inconvenient locations, e.g., near the roofline of the residence.

Another more subtle but performance-impacting issue is the potential degradation of Return Loss ("RL") from a resultant connection (also known as more signal reflection). RL is a measure of how closely the characteristic impedance of a connection matches. A mismatch increases RL and degradation of signal power transfer (more reflection). The higher the signal frequency, the greater is the potential for degradation. Everything else being equal, more connections in a given system results generally in more RL degradation.

Another potential for RL degradation with the conventional grounding blocks is moisture. Grounding blocks, such as those shown in FIGS. 1A-1C, are not easily isolated from moisture, e.g., requiring that they be enclosed in a sealed container or wrapped with a weather boot. Moisture in a connection may also change the system characteristic impedance.

The coaxial cable's characteristic impedance "$Z_0$" (measured in ohms) is determined by the following cable design formula:

$$Z_0=138.2/\sqrt{E_r}\log(D/ad)$$

where "$E_r$" is the dielectric constant of the cable core, "D" is the dielectric diameter, "d" is the conductor diameter, and "a" is the conductor strand factor.

As the signal frequencies extend higher, parasitic parameters may affect the basic formula more to make the $Z_0$ deviate from its intended value, thus causing RL degradation.

Accordingly, apparatus and methods for grounding coaxial cables or other electrical cables would be useful.

SUMMARY

The present invention is directed to apparatus and methods for grounding electrical cables, such as coaxial cables. More particularly, the present invention relates to grounding blocks and methods for using them.

In accordance with one embodiment, a system for grounding an antenna is provided that includes a length of coaxial cable including an inner conductor, a dielectric layer around the conductor, a shield layer around the dielectric layer, and an outer jacket; and a grounding block including a recess having a shape for receiving the coaxial cable therein, and one or more cutting elements within the recess having a size such that, when the coaxial cable is received in the recess, the one or more cutting elements penetrate the outer jacket to contact the shield layer without cutting into the dielectric layer.

In one embodiment, the system may also include a grounding wire connectable to the grounding block for grounding the shield layer, and, optionally, may include one or more fasteners for securing the grounding wire to the grounding block. For example, the one or more fasteners may include a passage for receiving the grounding wire therein and a locking mechanism for securing the grounding wire in the passage. The grounding block and the one or more cutting elements may be at least partially electrically conductive such that, when the grounding wire is connected to the grounding block, the shield layer of the coaxial cable is electrically coupled to the grounding wire.

In addition or alternatively, the coaxial cable may include connectors on first and second ends thereof, and the grounding block may be attached to an intermediate location of the coaxial cable between the first and second ends, e.g., without severing the cable between the first and second ends.

In an exemplary embodiment, the grounding block may include first and second block portions, each block portion at least partially defining the recess. The first and second block portions may be at least partially separable from one another to open the recess to allow the coaxial cable to be received therein, at least one block portion comprising the one or more cutting elements. In one embodiment, the first and second block portions may be hingedly attached to one another for opening the recess, while in another embodiment the first and second block portions may be completely separable from one another. The grounding block may include one or more fasteners for securing the block portions together, e.g., after the coaxial cable is received in the recess. In addition or alternatively, the grounding block may include one or more fasteners for securing the grounding block to a mounting surface.

In accordance with another embodiment, a grounding block is provided for grounding a coaxial cable that includes a first block portion comprising a first recess therein; a second block portion hingedly connected to the first block portion such that the first and second block portions are movable between open and closed positions, the second block portion including a second recess therein, the first and second recesses having a shape for securely receiving a coaxial cable therein when the first and second block portions are in the closed position; and one or more cutting elements in at least one of the first and second recesses, the one or more cutting elements. The cutting elements may have a shape for penetrating an outer jacket of a coaxial cable received in the first and second recesses to contact a shield layer of the coaxial cable without cutting into a dielectric layer of the coaxial cable.

Optionally, the grounding block may include one or more passages in at least one of the first and second block portions for receiving a grounding wire for grounding the shield layer of the coaxial cable received in the first and second recesses. Alternatively, a grounding wire may be coupled directly to the grounding block, e.g., to a hinged portion of one or both of the first and second block portions.

In one embodiment, each of the first and second blocks may include a pair of opposing sidewalls spaced apart from one another, each sidewall at least partially including a recess and a cutting element aligned with a recess and a cutting element in the opposing sidewall. For example, each cutting element may include a sharpened edge of a curved wall within the respective recess.

In accordance with still another embodiment, a method is provided for grounding a coaxial cable that includes placing a grounding block around a coaxial cable; cutting through an outer jacket of the coaxial cable with the grounding block placed around the coaxial cable to contact a shield layer of the coaxial cable without cutting into a dielectric layer thereof, and grounding the grounding block, thereby grounding the shield layer.

In one embodiment, the outer jacket may be at least partially cut by rotating the grounding block around the coaxial cable, thereby causing one or more cutting elements on the grounding block to cut through the outer jacket without cutting though the shield layer and into the dielectric layer.

Other aspects and features of the present invention will become apparent from consideration of the following description taken in conjunction with the accompanying drawings.

DETAILED DESCRIPTION OF THE EXEMPLARY EMBODIMENTS

Figure 2:
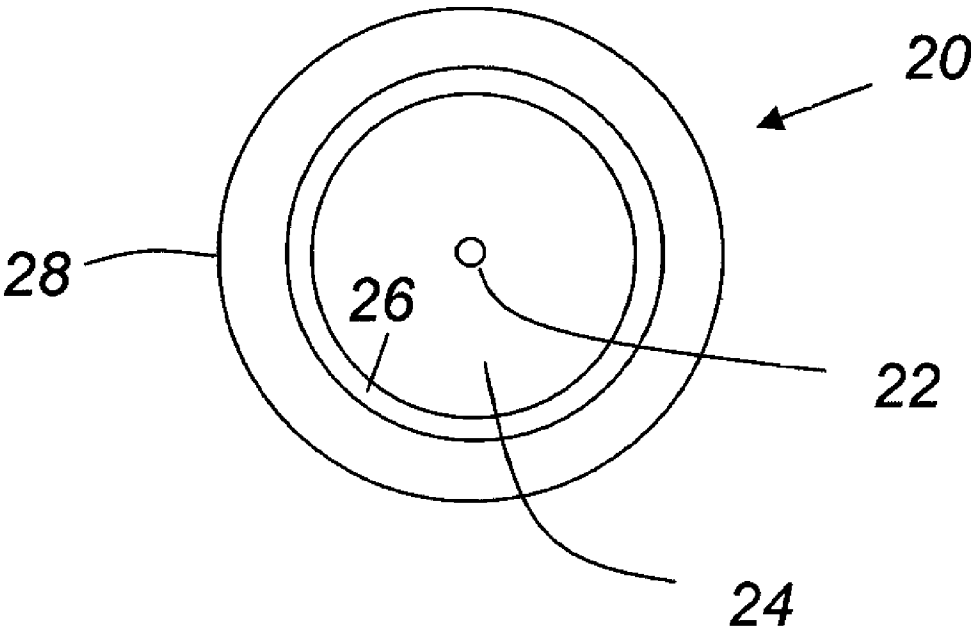
Fig. 2 Prior Art
FIG. 2 is a cross-sectional view of a conventional coaxial cable.
Figure 3:
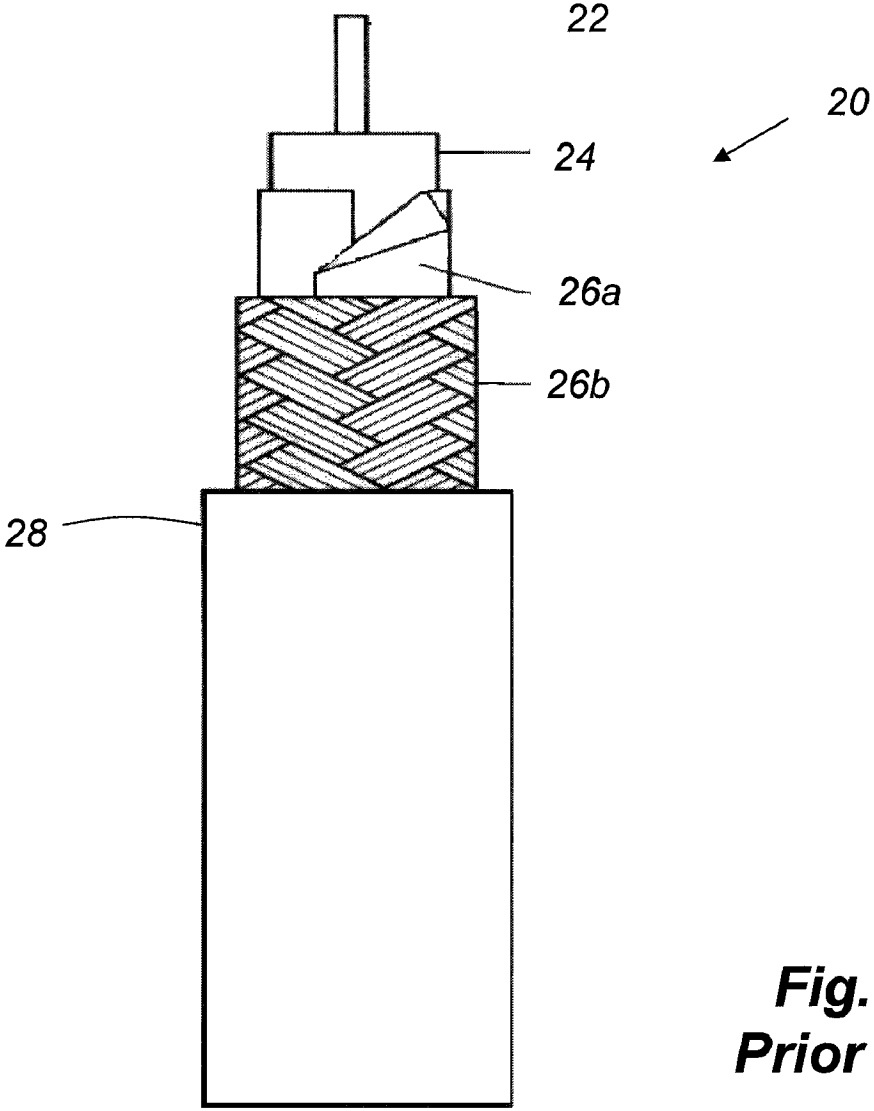
Fig. 3 Prior Art
FIG. 3 is a side view of a section of conventional coaxial cable including the outer jacket and shield partially removed to illustrate the construction of the cable.

Turning to the drawings, FIGS. 2 and 3 show an example of a section of conventional coaxial cable 20, which generally includes a center conductor 22 encompassed by a dielectric layer 24 that is itself encompassed by a foil/braided shield layer 26 and an outer jacket 28. The center conductor 22 may be formed from a variety of conductive materials, such as copper, steel, or copper-clad steel. The dielectric layer 24 may be formed from dielectric materials, such as solid polyethylene ("PE"), foamed polyethylene ("FP"), fluorinated ethylene propylene ("FEP"), foamed fluorinated ethylene propylene ("FFEP"), air dielectric/polyethylene ("AD/PE"), and the like.

As best seen in FIG. 3, the shield layer 26 may include an inner foil 26*a* and an outer braid 26*b*. In an exemplary embodiment, the foil 26*a* may be formed from aluminum bonded to both sides of a polypropylene or polyester tape, while the braid 26*b* may be formed from a flexible wire braid, e.g. of aluminum, copper, and the like. The outer jacket 28 may be formed from FEP, polyvinylidene fluoride, generic polyvinylidene fluoride, polyethylene, polyvinylchloride, and the like. Additional information regarding the construction of the coaxial cable 20 may be found in application Ser. No. 60/876,337, incorporated by reference above.

It will be appreciated that, for a given type of coaxial cable 20 (RG59, RG6, etc.), the outer diameter ("OD") of the dielectric layer 24 and the outer diameter ("OD") of the outer jacket 28, and the thickness of the outer jacket 28 are generally similar between different manufacturers. Thus, the thickness of the braided shield layer 26 may be easily determined, and the construction of the embodiments described herein may be adjusted to facilitate use with a variety of coaxial cables.

Figure 1C:
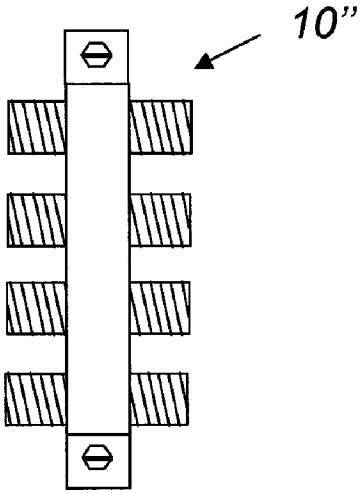
FIGS. 1A-1C are top views of conventional F-connector grounding blocks including single, dual, and quad versions, respectively.
Figure 1B:
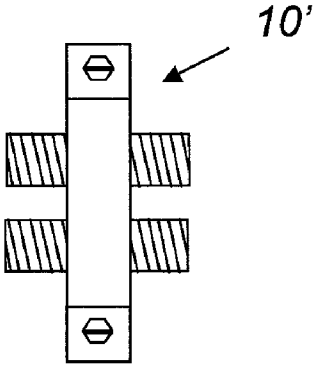
Figure 1A:
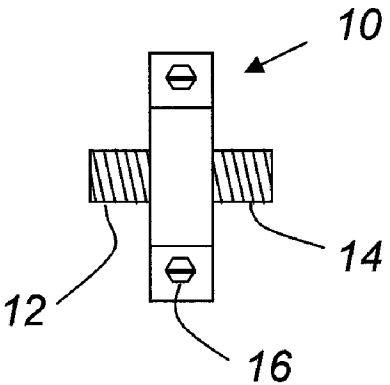
Fig. 1A Prior Art

Generally, the embodiments described herein may include one or more of the following advantages. For example, the embodiments described herein may be less costly and/or easier to install, e.g., as compared to the grounding block 10 shown in FIG. 1A. In addition, to cost and installation time savings, the embodiments described herein may satisfy one or more of the following technical criteria:

A) The embodiments described herein may result in substantially no physical discontinuity of the dielectric layer 24 and the braided shield layer 26. It is generally desirable that the dielectric layer 24 and the braided shield layer 26 not be cut during use of the embodiments described herein.

B) The desired grounding contact are with the braided shield layer 26 may be, at a minimum, equivalent to a gauge #8 aluminum wire or #10 copper wire, e.g., to accommodate adequate lightening current surges as intended by the NEC.

C) The coaxial cable, after grounding, may be substantially moisture-proof, e.g., such that the cable's performance is not degraded environmentally.

D) During use, the cuts through the outer jacket 28 may not cut substantially into the dielectric layer 24 of the cable 20, e.g., which may otherwise alter the characteristic impedance and/or degrade the RL of the cable 20.

For example, after installation, embodiments described herein: 1) may maintain the dielectric layer 24 and braided shield layer 26 substantially physically continuous, e.g., since the cable 20 is not cut; 2) may result in the grounding contact area to the braided shield 26 being buried into the braided shield mesh 26*b* (without penetrating to the foil 26*a*), while exceeding the cross-sectional contact area of a #8 wire; 3) may maintain the cable 20 substantially moisture-proof, e.g., since only the outer jacket 28 and/or since the embodiments naturally seal and/or clamp the outer jacket 28, e.g., to form weather boot; 4) may result in the grounding contact only reaching the braided shield 26, thereby leaving the dielectric layer 24 unaltered and/or substantially preserving the originally intended characteristic impedance and/or RL of the cable 20; and/or 5) may require no connectors to be attached to the cable 20 and/or no connections to be made with the cable 20, thereby possibly reducing costs and/or installation time.

Figure 4A:
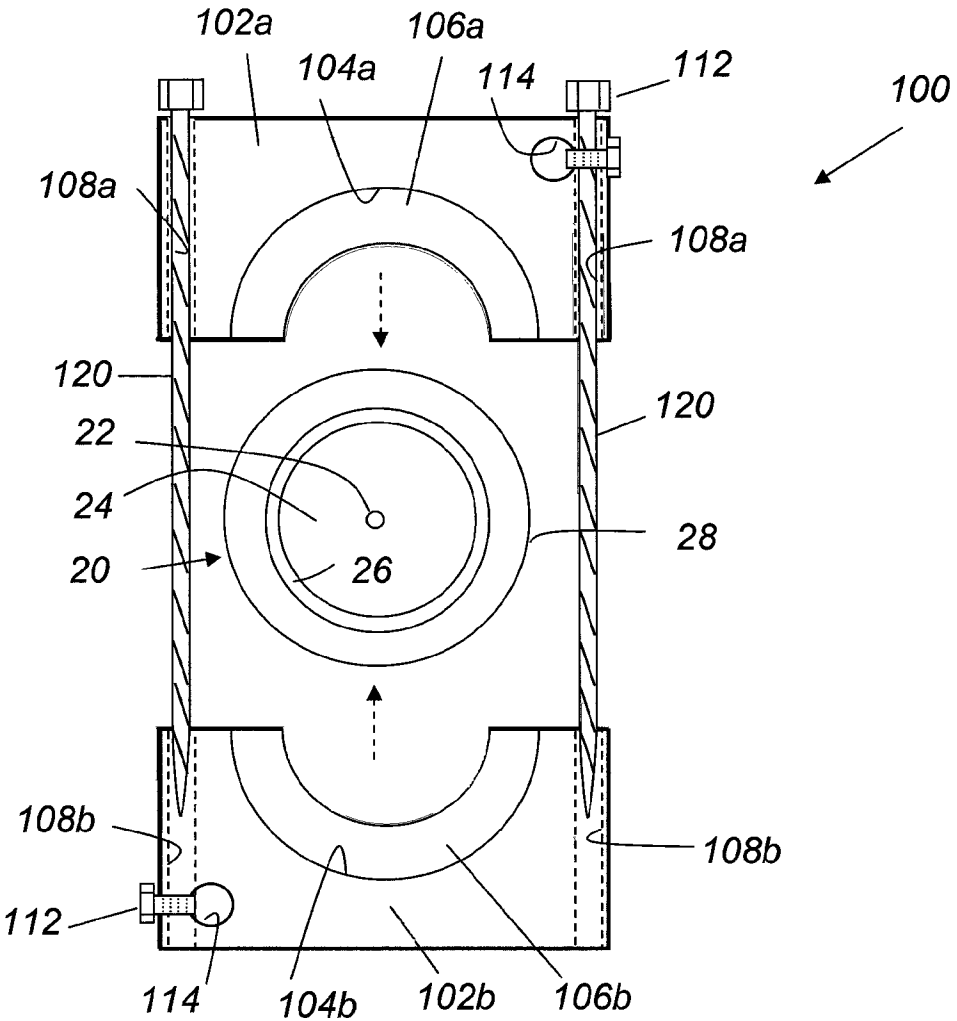
FIGS. 4A and 4B is a cross-sectional view of an exemplary embodiment of a grounding block in open and closed positions, respectively.
Figure 4B:
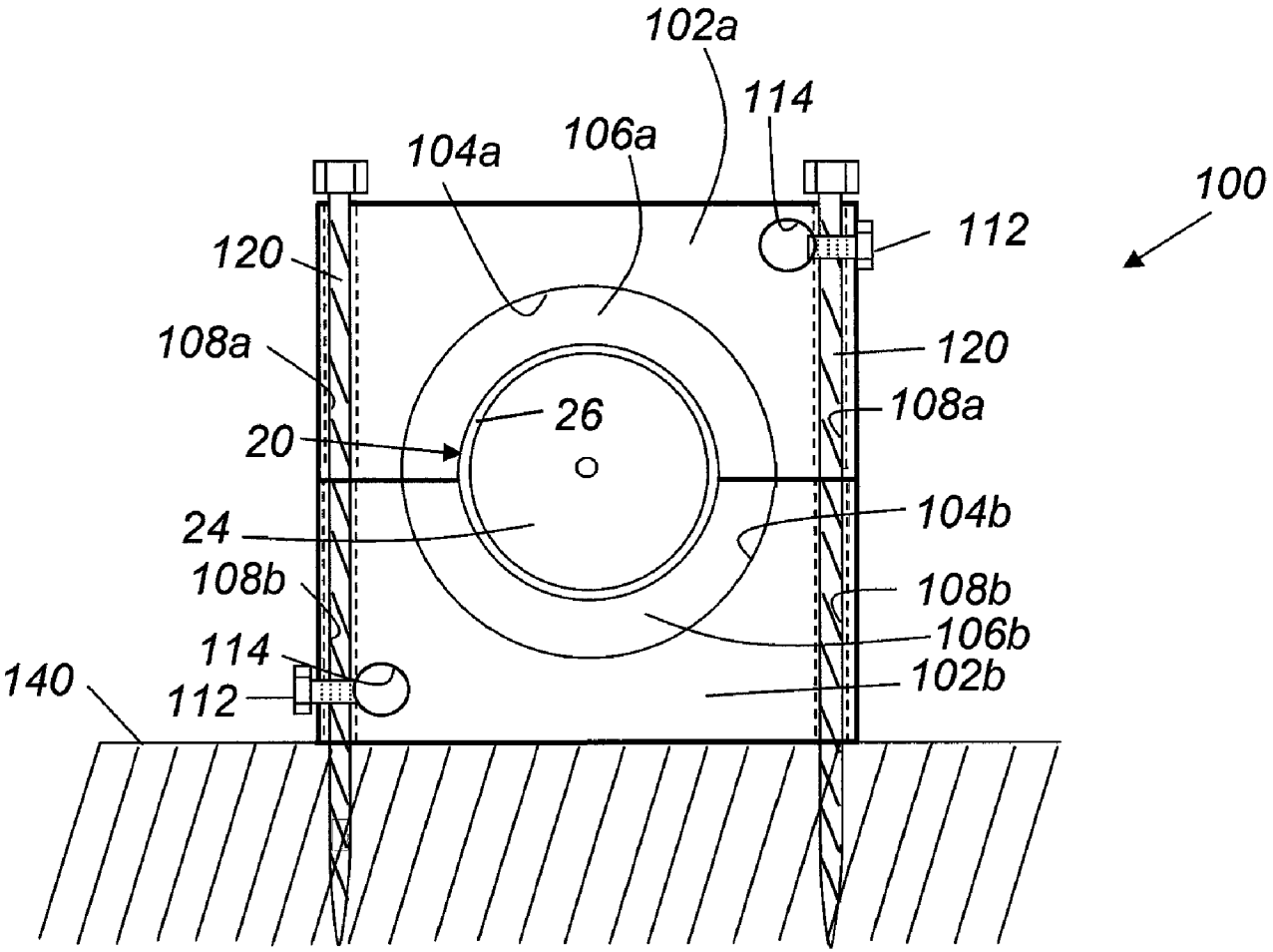

Turning to FIGS. 4A and 4B, an exemplary embodiment of a grounding block 100 is shown that generally includes first and second half blocks or clam shell housings 102. The upper or first half block 102*a* and the lower or second half block 102*b* may be constructed generally similar to one another, e.g., including a similarly shaped recess 104. Alternatively, the blocks 102 may have different shapes, as long as the blocks 102 may be at partially separated from one another and the recesses 104 allow a coaxial cable to be received therein.

One or both recesses 104 may include one or more cutting elements 106 therein. For example, as shown in FIGS. 4A and 4B, the cutting elements 106 may include a pair of opposing knife-sharp semi-circular blades 106*a*, 106*b* defining a similar inner radius. Alternatively, only one of the blocks (e.g., block 102*a*) may include one or more blades (e.g., blade 106*a*), while the other of the blocks may simply include a stop opposite the blade(s) (not shown). In another alternative, multiple pairs of opposing blades may be provided, e.g., spaced apart from one another within the recesses 104. In an exemplary embodiment, the recesses 104 may define a radius similar to the outer diameter of the outer jacket 28, while the inner radius of each blade 106*a*, 106*b* may be slightly larger than the outer radius of the dielectric layer 24 but slightly smaller than the inner radius of the outer jacket 28.

The blocks 102 may include one or more holes or passages 108 therethrough, which may be aligned with one another when the recesses 104 of the blocks 102 are disposed opposite and towards one another, as shown in FIGS. 4A and 4B.

The grounding block 100 also includes one or more fasteners 120, e.g., screws, nails, bolts, and the like, which may be received through the passages 108. One or more of the fastener(s) 120 may also be sufficiently long to be received through the passage(s) 108 in both half blocks 102 and, optionally, to enter into a mounting surface, e.g., as shown in FIG. 4B and described further below. For example, in one embodiment, the fasteners 120 may include a pair of threaded screws, and one or both passages 108*a*, 108*b* may also be threaded. The passage(s) 108*a* through the upper half block 102*a* may not include threads, but may be substantially smooth and larger than an outer diameter of the fasteners 120, while the passage(s) 108*b* through the lower half block 102*b* may be threaded similar to the fasteners 120. This arrangement may allow the fasteners 120 to be inserted through the passages 108*a* and then threaded into the passages 108*b* to draw the half blocks 102 towards one another, e.g., during installation, as described elsewhere herein. Alternatively, both sets of passages 108*a*, 108*b* may be substantially smooth and larger than the fasteners 120 to allow the fasteners 120 to pass freely through both half blocks 102 and/or to allow the half blocks 102 to be freely directed towards one another and/or separated from one another. In a further, alternative, both sets of passages 108*a*, 108*b* may be threaded, although this alternative may be slower to install because of the extra threading involved.

In addition or alternatively, the blocks 102 may include one or more screws or other locking mechanisms 112, e.g., receivable in passages 114. The screws 112 may be sufficiently long to be received in bores such that ends of the screws 112 enter the passages 114, e.g., to contact and/or bear against grounding wires and the like (not shown) received in the passages 114, as described elsewhere herein.

During use, as shown in FIG. 4A, the blocks 102 may be separated at least partially from one another (if not already separated) such that a section of coaxial cable 20 that is to be grounded may be disposed between the recesses 104. For example, the half blocks 102 may be separated completely from one another and placed around a cable 20, which may have been previously extended from an antenna (not shown) or other piece of equipment. The half blocks 102, with the blades 106 oriented towards the cable 20, may be clamped down towards each other with coaxial cable 20 therebetween to cause the blades 106 to penetrate through the jacket 28 of the cable 20 into the braided shield layer 26. Generally, this may be accomplished without previously cutting into or otherwise removing the outer jacket 28 from the cable 20.

For example, if the passages 108*a*, 108*b* are free from threads, the fasteners 120 may be inserted through the passages 108 and into a suitable mounting surface 140, e.g., a wall, roof, or other structure of a residence or other building supporting or adjacent to the antenna (not shown). If the fasteners 120 are screws, they may be threaded into the mounting surface 140, causing the half blocks 102 to capture and clamp down on the cable 20. If the fasteners 120 are nails, they may be hammered or otherwise forced into the mounting surface 140. The fasteners 120 may be advanced until the upper half block 102*a* substantially abuts the lower half block 102*b*, as shown in FIG. 4B. Because the inner radius of each blade is slightly larger than the outer radius of the dielectric layer 24 but slightly smaller than the inner radius of the jacket 28, the circle defined by the blades 106 may only cut through the outer jacket 28 into contact with but not cutting through the braided shield layer 26. The blades 106 may become buried in the braided shield layer 26 to form substantially continuous contact with the braided shield layer 26, e.g., to achieve the same or more effective cross-sectional contact to satisfy the NEC. Since the performance-determining layers of the cable 20 are not altered, the original specifications, such as characteristic impedance and RL of the cable 20, may be substantially preserved.

In addition, the two blocks 102 may compress the jacket 28 tightly, e.g., to form a natural weather boot substantially sealing the cable 20 from exposure to moisture.

In an alternative embodiment, before the fasteners 120 are advanced into the mounting surface 140 (and optionally through the passages 108), the blocks 102 may held tightly together with the cable 20 therebetween, either manually or by tightening the fasteners 120 into the blocks 102. The blocks 102 may then be rotated simultaneously around the cable 20 one or more times, which may enhance the blades 106 cutting through the jacket 28 into contact with the braided shield layer 26. The fasteners 120 may then be advanced through the passages 108 (if not already) and/or into the mounting surface 140. For example, one fastener may be sufficiently long to secure the blocks 102 together in the closed position, shown in FIG. 4B, while another longer fastener may then be advanced through the blocks 102 to secure the grounding block 100 to the mounting surface 140.

One or more grounding wires (not shown) may then be coupled to the grounding block 100. For example, a grounding wire may be advanced into the passage 114 and then the screw 112 may be threaded or otherwise advanced into the passage 114 to contact and secure the grounding wire to the block 102. A grounding wire may be introduced and secured into passages 114 on both blocks 102 or only one of the blocks 102. The block(s) 102 may be electrically coupled to the blade(s) 106, e.g., by providing the block 102 and blade 106 from metal or other electrically conductive material that is electrically coupled (as well as physically attached) to one another. Thus, with the blades 106 contacting the braided shield layer 26, the grounding wire may be coupled to the braided shield layer 26 via the block 102 and blade 106. Although passages 114 are shown in both blocks 102, optionally, one of the passages 114 and screws 112 may be eliminated if sufficient electrical contact may be achieved with a single grounding wire.

Figure 5B:
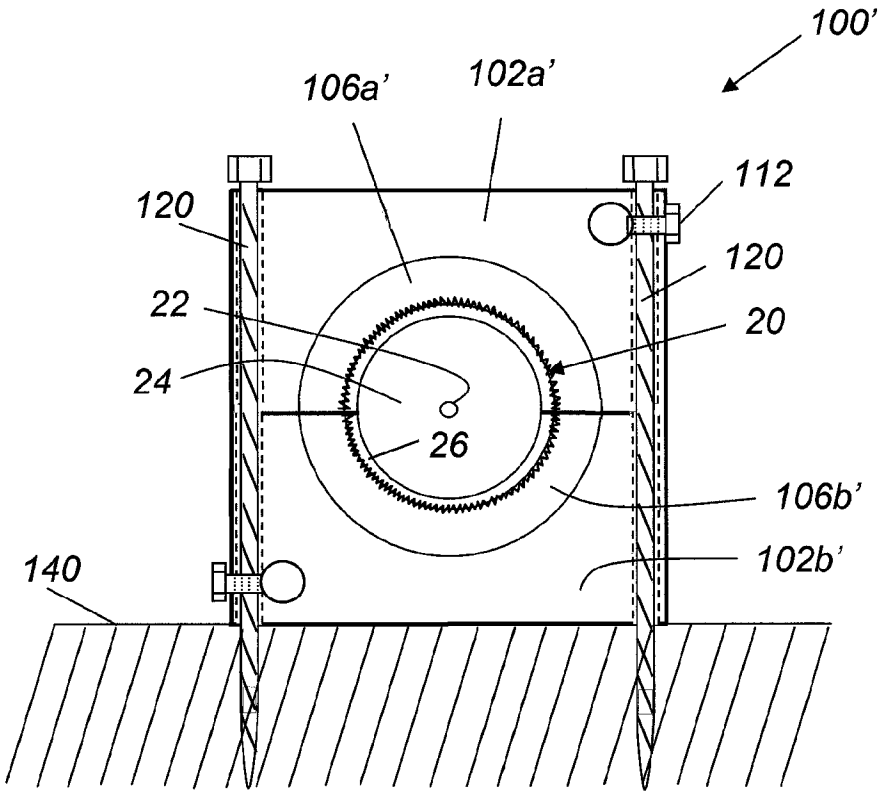
FIGS. 5A and 5B is a cross-sectional view of another embodiment of a grounding block in open and closed positions, respectively.
Figure 5A:
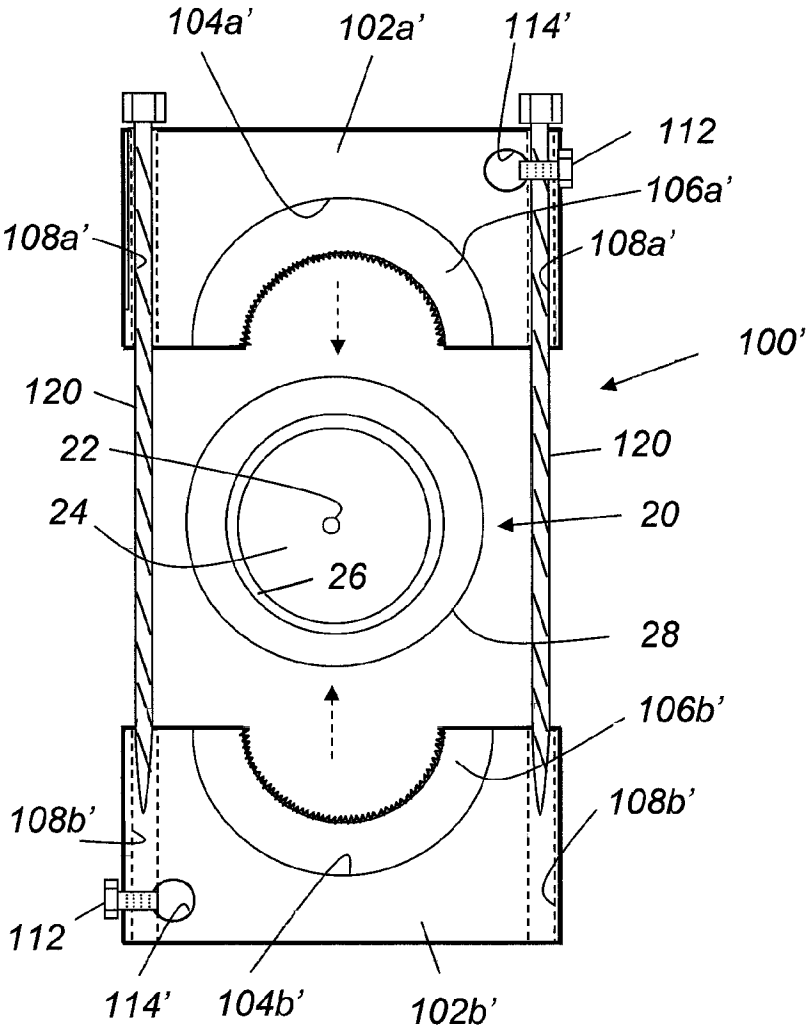

Turning to FIGS. 5A and 5B, an alternative embodiment of a grounding block 100' is shown, which includes first and second blocks 102' generally similar to the grounding block 100 of FIGS. 4A and 4B. However, the grounding block 100' includes blades 106' that have saw-tooth like edges rather than knife-sharp edges. The number and the size of the teeth may varied to provide a desired ability to cut through the outer jacket 28 as long as sufficient equivalent continuous contact area is achieved with the braided shield layer 26, e.g., at least the same or more than the cross-sectional area of a #8 gauge Aluminum wire to maintain the lightening-handling capabilities.

When installing the grounding block 100,' clamping action and/or rotational action may be employed to ensure that the blades 106' cut substantially through the outer jacket 28 to contact the braided shield layer 26. Optionally, to enhance cutting and/or observe that proper penetration has been achieved (using any of the embodiments described herein), the cable 20 may be pulled axially away from the grounding block 100, e.g., to reveal the braided shield layer 26 and confirm that the outer jacket 28 has been completely penetrated.

Upon proper installation, the continuity of the dielectric layer 24 and braided shield layer 26 may be substantially maintained since only the outer jacket 28 is cut by the blades 106.' The blades 106' may not cut into the dielectric layer 22 and, therefore, may not alter the characteristic impedance and/or RL of the cable 20. However, substantially continuous grounding contact may be achieved with the braided shield layer 26 by the blades 106' (or by multiple sets of blades 106'), e.g., providing a contact area that may be equivalent to or greater than the cross-section area of a gauge #8 wire. Because only the portion of the outer jacket 28 immediately beneath the blades 106' is cut, the resulting connection and the cable may be substantially moisture-proof.

Figure 6:
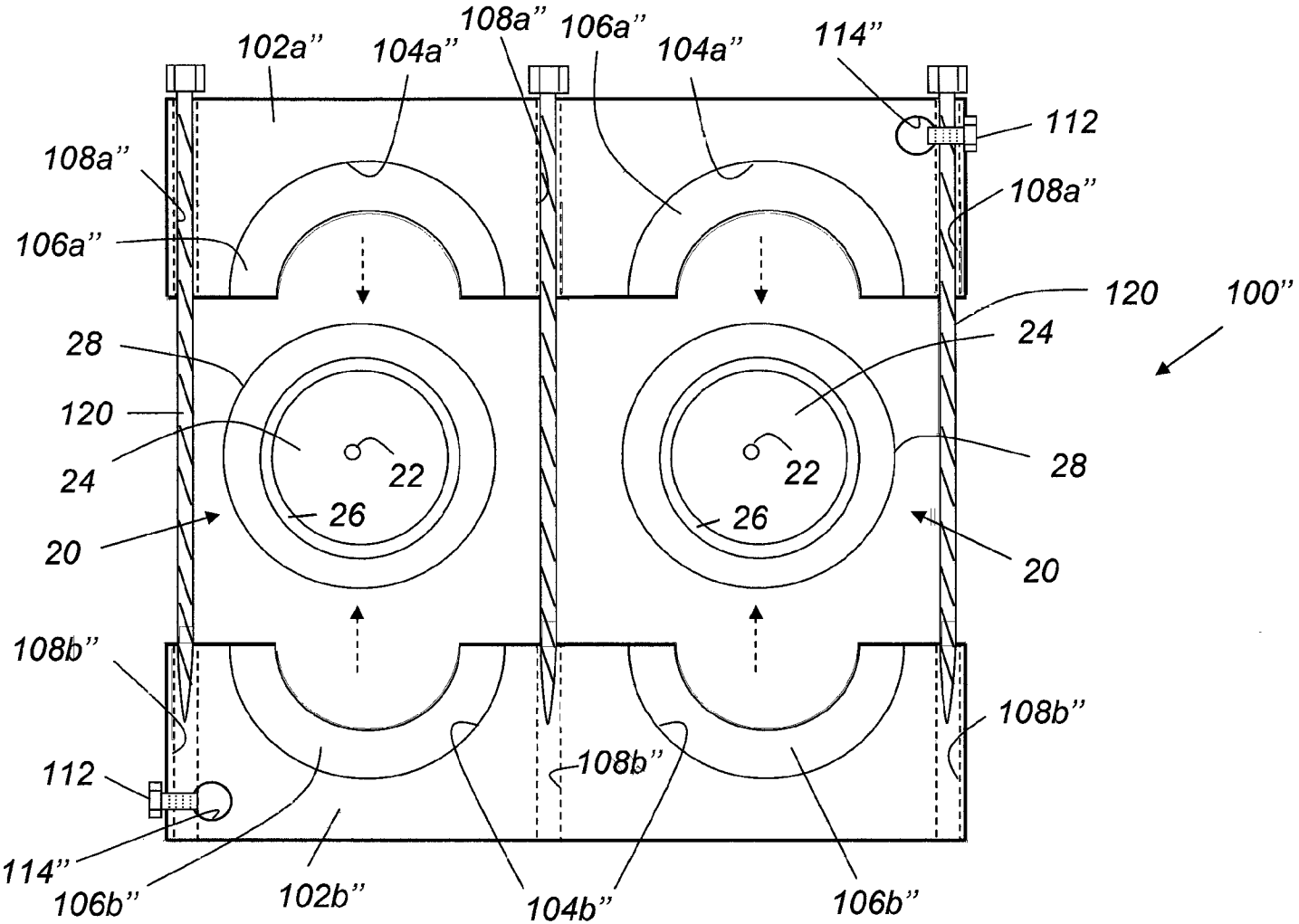
FIG. 6 is a cross-sectional view of yet another embodiment of a grounding block for grounding two coaxial cables in an open position.

Turning to FIG. 6, another embodiment of a grounding block 100" is shown, which includes first and second blocks 102" generally similar to the grounding block 100 of FIGS. 4A and 4B. However, unlike the previous embodiments, each of the blocks 102" includes two recesses 104" including one or more cutting elements 106." In addition, the blocks 102" include passages 108" for receiving fasteners 120, with three passages 108" shown in FIG. 6, and passages 114" for receiving grounding wires (not shown), which may be secured using screws 112. As shown, the cutting elements 106" include two opposing pairs of opposing knife-sharp semi-circular blades 106*a*," 106*b*" in the opposite recesses 104" in the blocks 102." Because the inner radius of each blade 106" is slightly larger than the outer radius of the dielectric layer 24 but slightly smaller than the inner radius of the outer jacket 28, the resulting space defined between the blades 106" when the grounding block 100" is closed only cuts through the outer jacket 28 of the cables 20 but not through the shield layer 26 or the rest of the cable 20. Alternatively, as for any of the other embodiments herein, the cutting elements 106" may include teeth or other structures (not shown), as desired.

Figure 7:
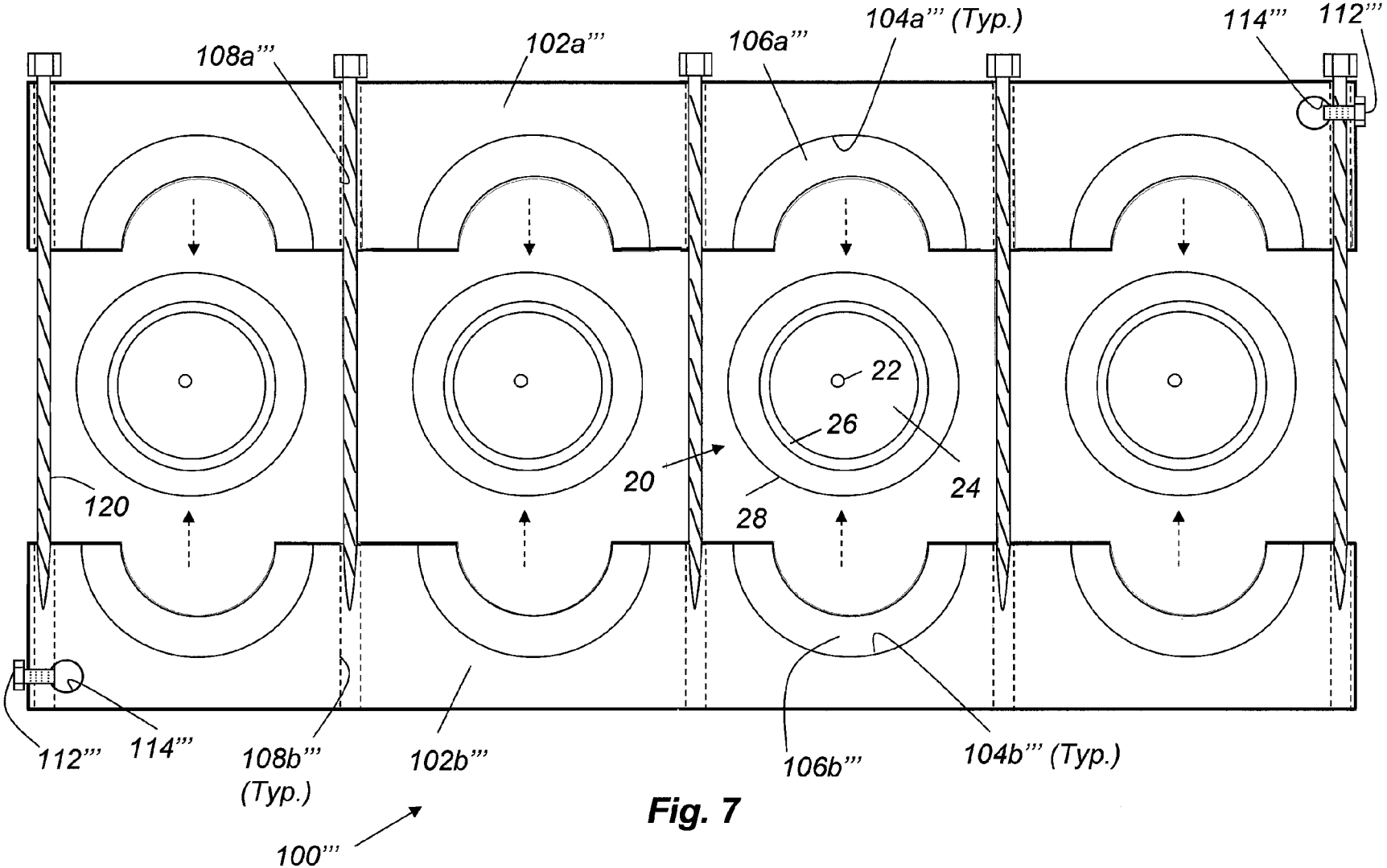
FIG. 7 is a cross-sectional view of still another embodiment of a grounding block for grounding four coaxial cables in an open position.

Turning to FIG. 7, still another embodiment of a grounding block 100'" is shown, which includes first and second blocks 102'" generally similar to the grounding block 100 of FIGS. 4A and 4B. However, unlike the previous embodiments, each of the blocks 102'" includes four recesses 104'" including one or more cutting elements 106.'" In addition, similar to the previous embodiments, the blocks 102'" include passages 108'" for receiving fasteners 120, with five passages 108'" shown in FIG. 7, and passages 114'" for receiving grounding wires (not shown), which may be secured using screws 112. As shown, the cutting elements 106" include four opposing pairs of opposing knife-sharp semi-circular blades 106*a*,'" 106*b*'" in the opposite recesses 104'" in the blocks 102.'"

Manufacturing, installation, or other use of the grounding blocks 100," 100'" in FIGS. 6 and 7 may be similar to other embodiments herein. Optionally, only one or two of the fasteners 120 may be sufficiently long to mount the grounding blocks 100," 100'" to a mounting surface (not shown). In addition, because multiple coaxial cables 20 may be grounded and secured within the grounding blocks 100," 100'" substantially simultaneously, it may not be possible to rotate the grounding blocks 100," 100'" to cut the outer jackets 28. Instead, the force of closing the blocks 102," 102'" should be sufficient to cut the outer jackets 28 substantially simultaneously.

Although grounding blocks are shown for grounding one, two, or four coaxial cables, it will be appreciated that grounding blocks may be provided that accommodate any desired number of cables.

Figure 8B:
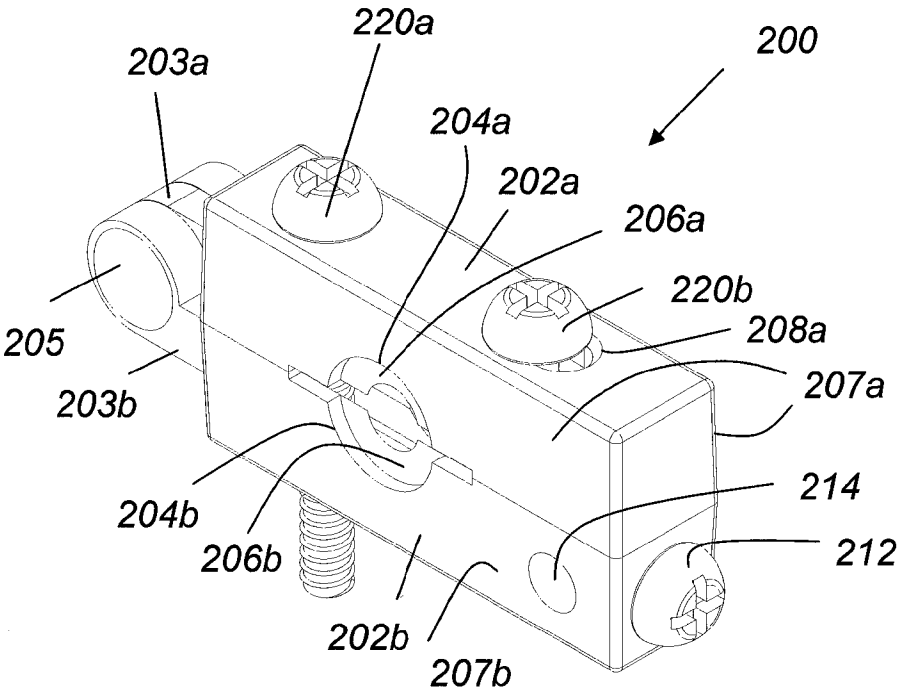
FIGS. 8A and 8B are perspective views of yet another embodiment of a grounding block in open and closed positions, respectively.
Figure 8A:
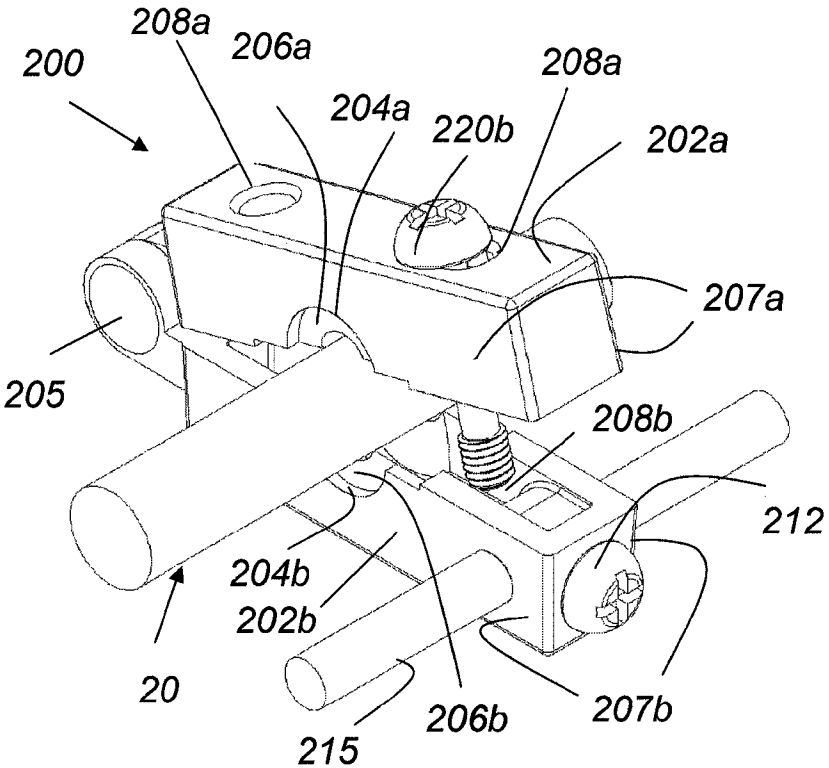

Turning to FIGS. 8A and 8B, yet another embodiment of a ground block 200 is shown, which generally includes first and second blocks 202 generally similar to the grounding block 100 of FIGS. 4A and 4B. However, unlike the previous embodiments, the blocks 202 include hinge portions 203 rotatably coupled to each other by a pin 205. It will be appreciated that other hinges may be provided to allow the blocks 202 to be rotated towards and away from one another, e.g., between the open position shown in FIG. 8A and the closed position shown in FIG. 8B.

Each of the blocks 202 include one or more recesses 204 including one or more cutting elements 206. As shown, each block 202 includes sidewalls 207 spaced apart from one another, with each of the sidewalls 207 include a recess 204 and cutting element 206. In addition, each block 202 may include one or more passages 208 for receiving fasteners 220, with two passages 208 provided in the embodiment shown in FIGS. 8A and 8B. At least one block 202*b* may also include a passage 214 (shown in FIG. 8B) for receiving a grounding wire 215 (shown in FIG. 8A).

The blocks 202 may be formed from metal, such as cold rolled steel, galvanized steel, stainless steel, aluminum, and the like, or other conductive material. For example, each of the blocks 202 and their features, e.g., hinge portions 203, recesses 204, cutting elements 206, and passages 208, 214 may be formed from a single piece, e.g., by casting, machining, molding, and the like. For example, the blocks 202 and most of its features may be formed as a casting, with any threads in the passages 208, 214 added afterwards using conventional methods. The cutting elements 206 may be formed directly into the sidewalls 207, e.g., by grinding or otherwise created a knife-sharp edge around the edge of the recesses 204. As shown, the cutting elements 206 may be recessed into the sidewalls 207, which may reduce exposure of the cut cable 20 secured between the blocks 202, as described further below.

As shown, the grounding block 200 also includes screws, bolts, or other fasteners 220, which may be received in the passages 208. As shown in FIG. 8B, a first screw 220*a* may be longer than a second screw 220*b* such that the end of the first screw 220*a* extends through and beyond both blocks 202, e.g., for securing the grounding block 200 to a mounting surface (not shown), similar to the previous embodiments. The second screw 220*b* includes a threaded end and an unthreaded intermediate region such that the second screw 220*b*. The upper block 202*a* may include an unthreaded corresponding passage 208*a* and the lower block 202*b* may include a threaded corresponding passage 208*b*. Thus, the second screw 220*b* may be unthreaded and threaded rapidly to facilitate releasing and securing the blocks 202.

In addition, the grounding block 202 may include a set screw or other locking mechanism 212 for securing a grounding wire 215 within the passage 214, as shown in FIG. 8A. Installation and/or other use of the grounding block 200 may proceed similar to the grounding block 100 shown and described with reference to FIGS. 4A and 4B, except that the blocks 202 are hingedly separated from one another to accommodate a coaxial cable 20 being received in the recesses 204. After the second screw 220*b* is threaded into the lower block 202*b* to close and secure the blocks 202 tightly together, the grounding block 200 may optionally be rotated around the cable 20 to ensure that the cutting elements 206 cut through the outer jacket (not shown in FIGS. 8A and 8B) and contact the shield layer (also not shown), thereby electrically coupling the shield layer to the grounding wire 215.

Figure 9:
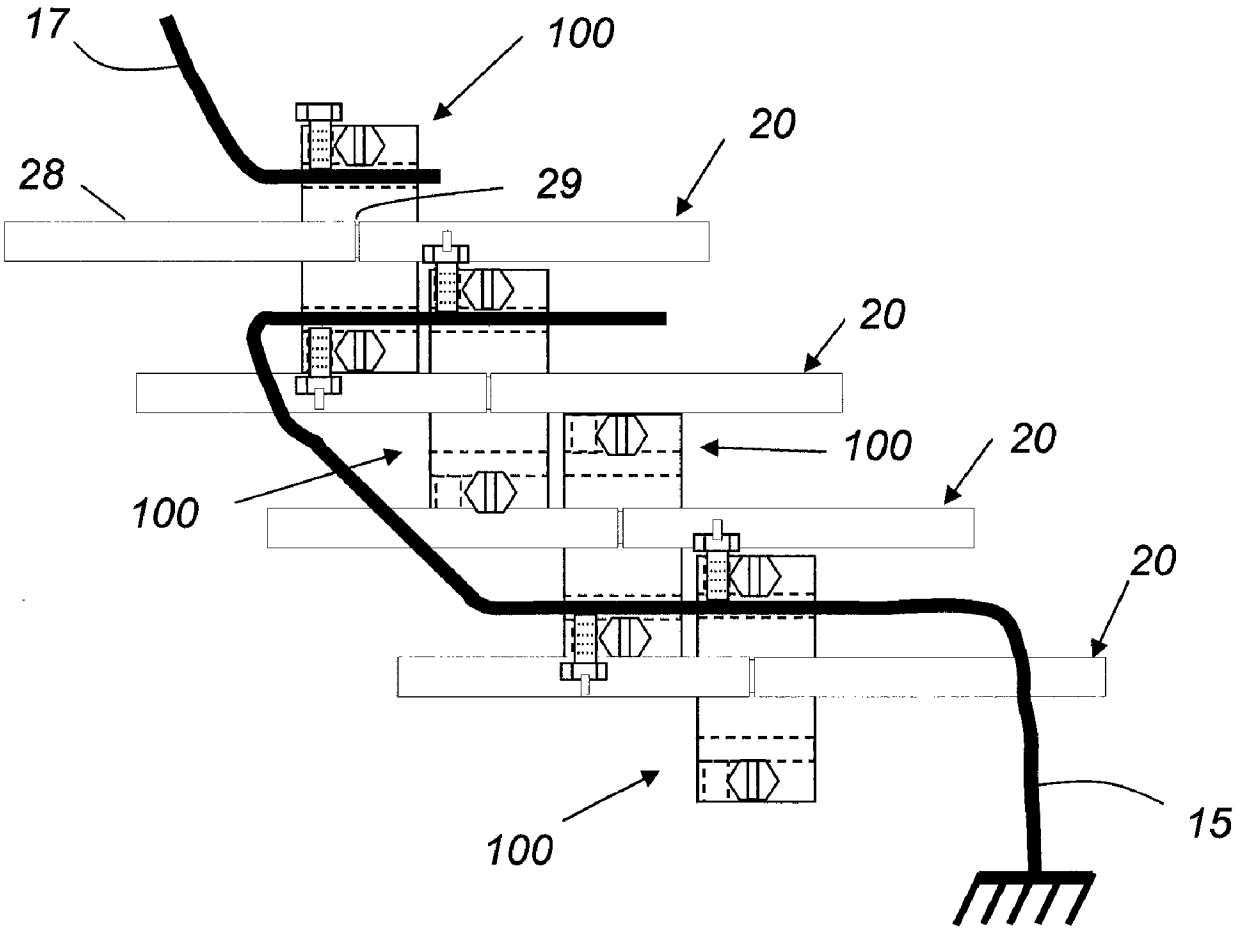
FIG. 9 is a top view of yet another embodiment of a set of single grounding blocks configured for grounding four coaxial cables and including a grounding wire coupled to the grounding blocks to ground the cables.

Turning to FIG. 9, a set of four grounding blocks 100 are shown, e.g., similar to those shown in FIGS. 4A and 4B (or alternatively any other single cable embodiment herein). As shown, four cables 20 are received and secured within respective grounding blocks 100, with the ground blocks 100 cutting through the outer jacket 28 at location 29, e.g., to couple the shield layer (not shown) to the respective grounding blocks 100. A grounding wire 15 is shown coupled serially and secured to the grounding blocks 100, which is also grounded to a desired location, e.g., a cold water pipe or other approved grounding site. One of the grounding blocks 100 also includes another wire 17 coupled and secured thereto, which may be connected to another device, such as an antenna (not shown), to ground that device as well without needing to run a separate grounding wire.

It will be appreciated that a single grounding wire 15 (or multiple wires) may be looped through and/or otherwise coupled to multiple grounding blocks 100 in a number of ways. If the grounding blocks 100 include multiple passages for grounding wires, not all of the passages need to be used, as long as each grounding block 100 has at least one screw-secured grounding contact. The grounded group of grounding blocks 100 may also serve as a central point for grounding other components, e.g., as represented by wire 17.

Figure 10:
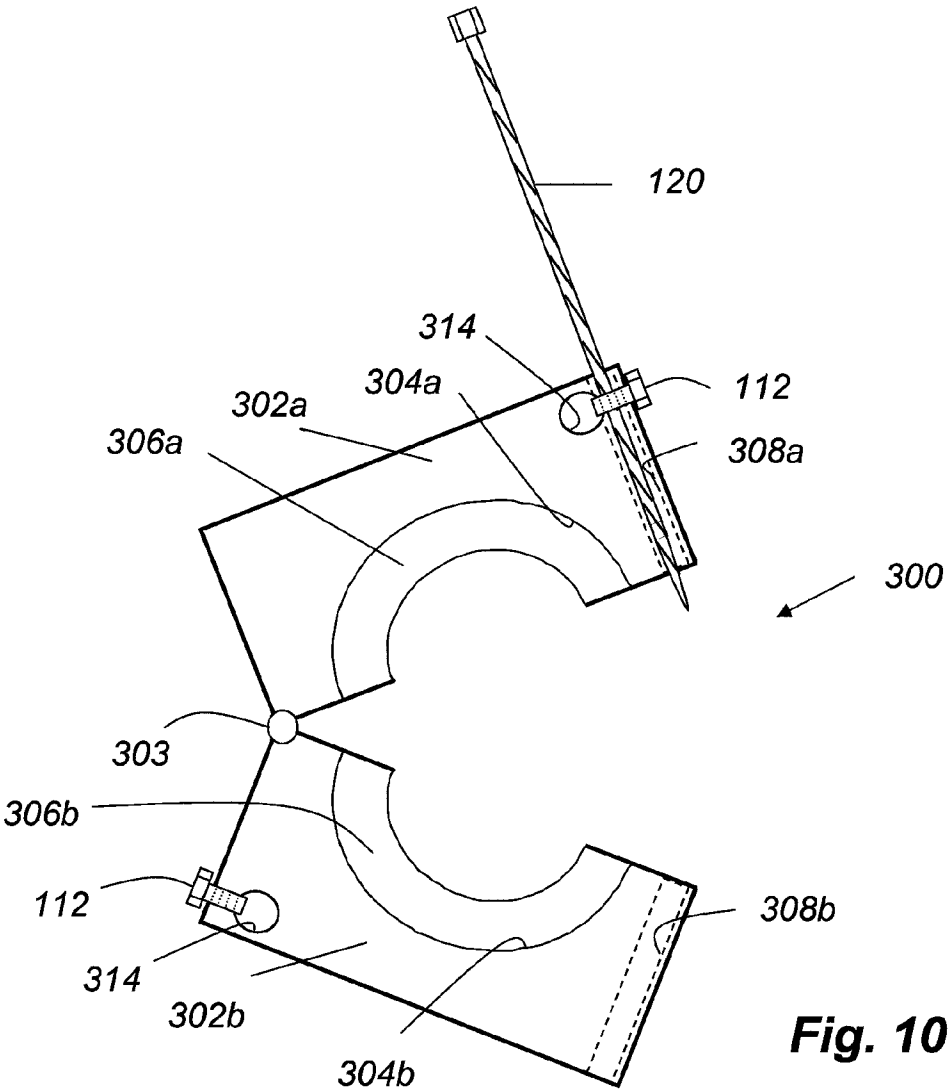
FIGS. 10-15 are cross-sectional views of alternative embodiments of a grounding block in an open position.

Turning to FIGS. 10-15, alternative embodiments of grounding blocks are shown, which are generally similar to the previous embodiments. For example, FIG. 10 shows a grounding block 300 that includes a pair of half blocks 302 connected by a hinged region 303, e.g., similar to the embodiment shown in FIGS. 8A and 8B. Each of the blocks 302 includes a recess 304 having one or more cutting elements 306 therein, similar to the embodiment shown in FIGS. 4A and 4B. In addition, each of the blocks 302 include passages 308 for receiving a screw or other fastener 120, and passages 314 for receiving a grounding wire (not shown), which may be secured using a screw or other locking mechanism 112, also similar to previous embodiments.

Figure 11:
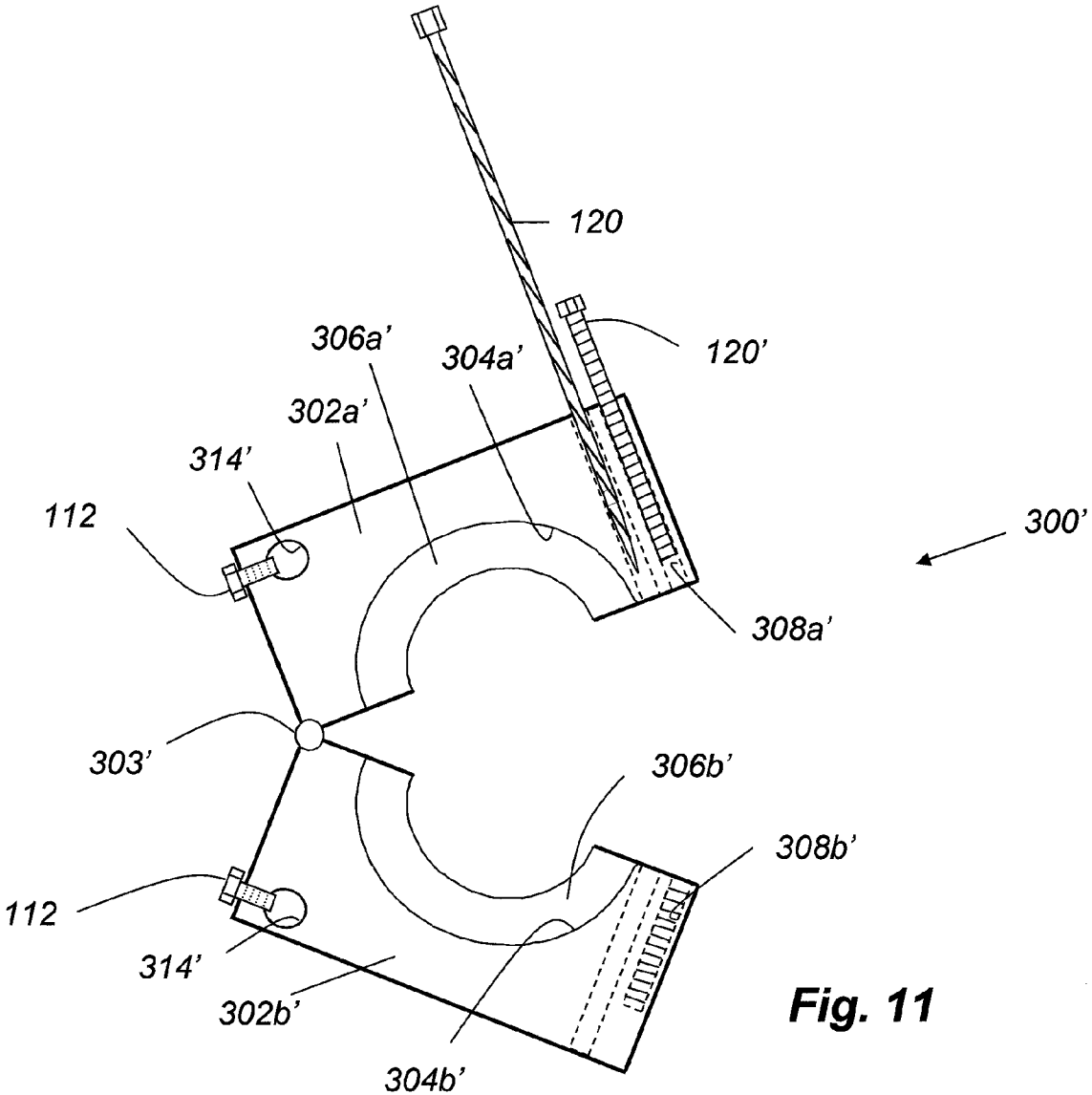
Figure 12:
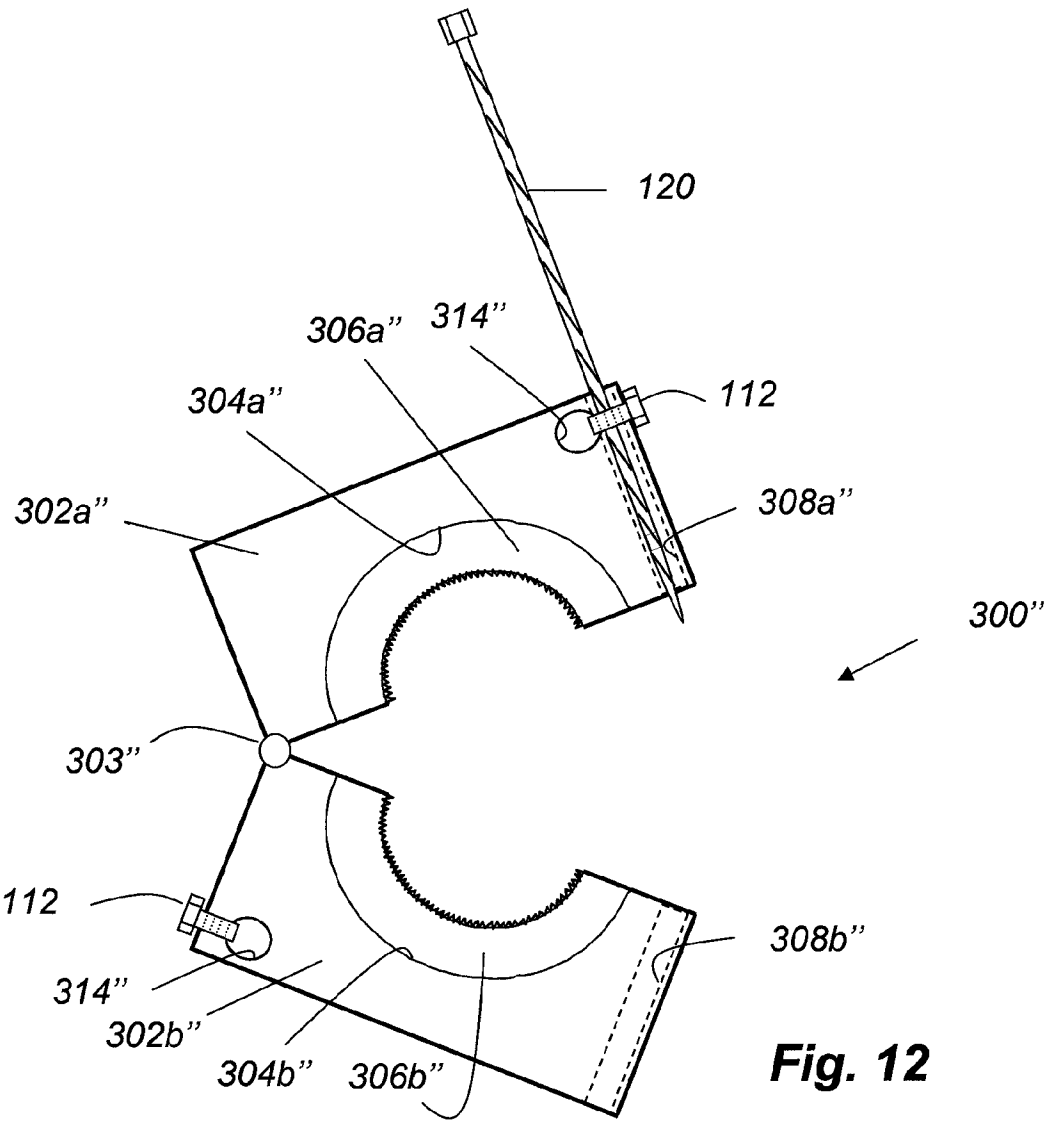
Figure 13:
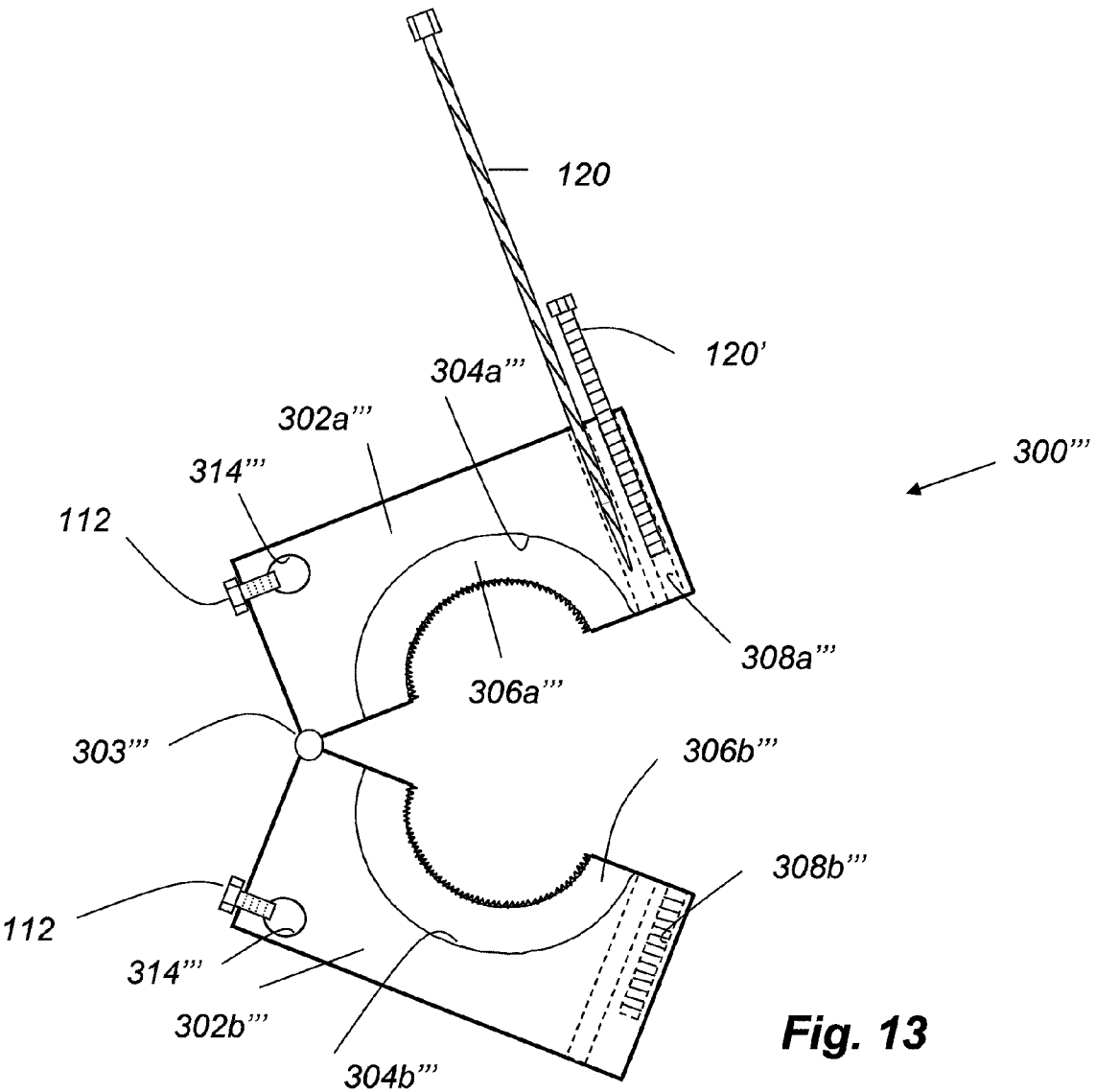
Figure 15:
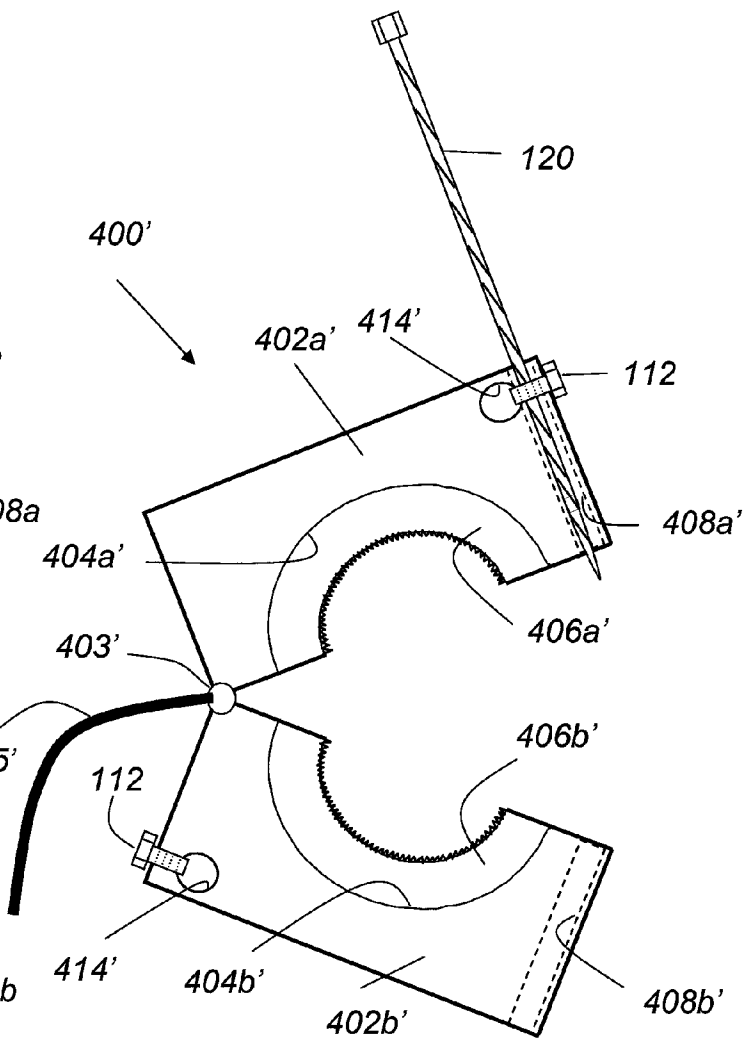

Turning to FIG. 11, a grounding block 300' is shown that is generally similar to the embodiment shown in FIG. 10, except that the half blocks 302' include two sets of passages 308' for receiving respective fasteners 120, 120.' The first fastener 120 may be longer than the second fastener 120,' e.g., such that the grounding block 300' may be secured to a mounting surface (not shown) using the first fastener 120, while the second fastener 120' may be used to secure the half blocks 302' together. The grounding blocks 300," 300'" shown in FIGS. 12 and 13, respectively, are generally similar to the embodiments shown in FIGS. 10 and 11, respectively, except that the cutting elements 306," 306'" include teeth.

Figure 14:
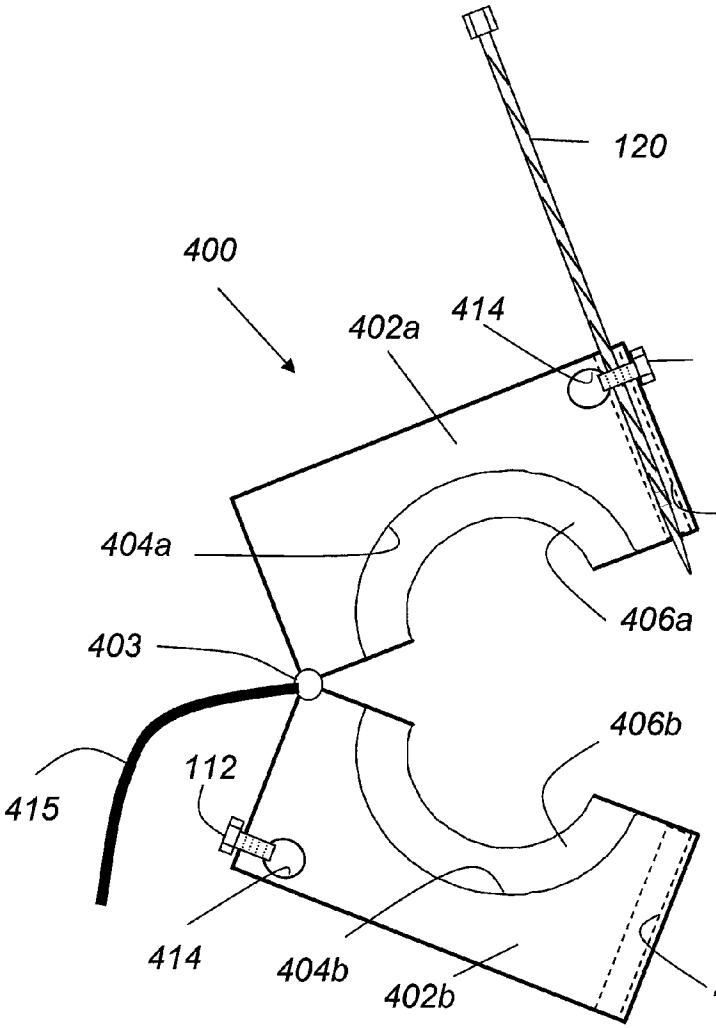

Turning to FIG. 14, another embodiment of a grounding block 400 is shown that includes a hinge 403 coupled to a grounding wire 415, rather than providing a separate passage for the grounding wire 415. For example, the grounding wire 415 itself may be used as the hinge pin for hingedly coupling the blocks 402 together. In this embodiment, the holes through the hinge portions of the blocks 402 should be sized to receive the grounding wire 415 snuggly, e.g., to prevent the blocks 402 from being loosely connected to one another. Alternatively, the grounding wire 415 may simply be coupled to the hinge pin (not shown) or to one or both of the hinge components of the blocks 402, e.g., by soldering, welding, bonding with adhesive, and the like. The alternative grounding block 400' shown in FIG. 15 may be similar to the embodiment shown in FIG. 14, except that the cutting elements 406' include teeth rather than simply being knife-sharp blades 406, as shown in FIG. 14.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the scope of the appended claims.

I claim:

1. A system for grounding an antenna, comprising:

a length of coaxial cable comprising an inner conductor, a dielectric layer around the conductor, a shield layer around the dielectric layer, and an outer jacket; and a grounding block comprising a recess having a shape for receiving the coaxial cable therein, the grounding block being openable to allow the coaxial cable to be received in the recess, the grounding block further comprising one or more blade cutting elements having a cutting edge defining a radius within the recess having a size such that, when the coaxial cable is received in the recess and the grounding block is closed, the one or more cutting elements penetrate the outer jacket to contact the shield layer without cutting into the dielectric layer;

wherein the grounding block comprises first and second block portions, each block portion at least partially defining the recess, the first and second block portions being at least partially separable from one another to open the recess to allow the coaxial cable to be received therein, at least one block portion comprising the one or more cutting elements;

wherein each cutting element comprises a sharpened edge of a curved wall within the respective recess.

2. The system of claim 1, further comprising a grounding wire connectable to the grounding block for grounding the shield layer.

3. The system of claim 2, wherein the grounding block comprises a fastener for securing the grounding wire to the grounding block.

4. The system of claim 3, wherein the fastener comprises a passage for receiving the grounding wire therein and a locking mechanism for securing the grounding wire in the passage.

5. The system of claim 2, wherein the grounding block and the one or more cutting elements are at least partially electrically conductive such that, when the grounding wire is connected to the grounding block, the shield layer of the coaxial cable is electrically coupled to the grounding wire.

6. The system of claim 1, wherein the coaxial cable comprises connectors on first and second ends thereof, and wherein the grounding block is attached to an intermediate location of the coaxial cable between the first and second ends.

7. The system of claim 1, wherein each of the first and second block portions comprises at least one cutting element.

8. The system of claim 1, wherein the first and second block portions are hingedly attached to one another for opening the recess.

9. The system of claim 1, wherein the grounding block further comprises one or more fasteners for securing the block portions together after the coaxial cable is received in the recess.

10. The system of claim 1, further comprising one or more fasteners for securing the grounding block to a mounting surface.

11. The system of claim 10, wherein the ground block comprises one or more passages therethrough for receiving the one or more fasteners therethrough.

12. The system of claim 10, wherein the grounding block comprises first and second block portions, each block portion at least partially defining the recess, the first and second block portions being at least partially separable from one another to open the recess to allow the coaxial cable to be received therein, the one or more fasteners being receivable through the first and second block portions for securing the first and second block portions closed around the coaxial cable.

13. A grounding block for grounding a coaxial cable comprising an inner conductor, a dielectric layer around the conductor, a shield layer around the dielectric layer, and an outer jacket, the grounding block comprising:

a first block portion comprising a first recess therein;

a second block portion hingedly connected to the first block portion such that the first and second block portions are movable between open and closed positions, the second block portion comprising a second recess therein, the first and second recesses having a shape for securely receiving a coaxial cable therein when the first and second block portions are in the closed position;

one or more cutting elements in at least one of the first and second recesses, the one or more cutting elements having a cutting edge defining a radius for penetrating an outer jacket of a coaxial cable received in the first and second recesses to contact a shield layer of the coaxial cable without cutting into a dielectric layer of the coaxial cable; and a passage in at least one of the first and second block portions for receiving a grounding wire for grounding the shield layer of the coaxial cable received in the first and second recesses;

wherein each of the first and second block portions comprises a pair of opposing sidewalls spaced apart from one another, each sidewalls at least partially comprising a recess and a cutting element aligned with a recess and a cutting element in the opposing sidewall;

wherein each cutting element comprises a sharpened edge of a curved wall within the respective recess.

14. The grounding block of claim 13, wherein the at least one of the first and second block portions comprising the passage and the one or more cutting elements are at least partially electrically conductive such that, when a grounding wire is received in the passage, the shield layer of the coaxial cable is electrically coupled to the grounding wire.

15. The grounding block of claim 13, further comprising a screw receivable in the passage for securing the grounding wire in the passage.

16. The grounding block of claim 13, wherein each of the first and second block portions, the pair of opposing sidewalls thereof, and the cutting elements in the opposing sidewalls are integrally formed from a single piece.

17. The grounding block of claim 13, further comprising one or more fasteners receivable through the first and second block portions in the closed position.

18. The grounding block of claim 13, further comprising one or more fasteners receivable through at least one of the first and second block portions for attaching the grounding block to a mounting surface.

19. A grounding block for grounding a coaxial cable comprising an inner conductor, a dielectric layer around the conductor, a shield layer around the dielectric layer, and an outer jacket, the grounding block comprising:

a first block portion comprising a first recess therein;

a second block portion hingedly connected to the first block portion such that the first and second block portions are movable between open and closed positions, the second block portion comprising a second recess therein, the first and second recesses having a shape for securely receiving a coaxial cable therein when the first and second block portions are in the closed position;

one or more blades extending across at least one of the first and second recesses, the one or more blades having a cutting edge with a sharpened edge of a curved wall defining a radius slightly smaller than an inner radius of an outer jacket of the coaxial cable received in the first and second recesses such that the one or more blades penetrate an outer jacket of the coaxial cable when the first and second block portions are in the closed position such that the one or more blades contact a shield layer of the coaxial cable without cutting into a dielectric layer of the coaxial cable; and a connector for connecting a grounding wire to at least one of the first and second block portions for grounding the shield layer of the coaxial cable received in the first and second recesses, wherein the one or more blades are at least partially electrically conductive such that, when a grounding wire is connected to at least one of the first and second block portions, the shield layer of the coaxial cable is electrically coupled to the grounding wire.

20. The grounding block of claim 19, wherein one of the first and second block portions has a passage therethrough for receiving a grounding wire therein, the connector comprising a fastener for securing the grounding wire in the passage.

21. The grounding block of claim 19, wherein both the first and second block portions have blades extending across the first and second recesses.

22. The grounding block of claim 21, wherein the blades are disposed opposite one another when the first and second block portions are in the closed position such that the blades define a circle defined by the radius of the blades.

23. The grounding block of claim 21, wherein the first and second block portions are formed from conductive material and the blades are formed directly into sidewalls of the first and second block portions.

* * * * *